US006190140B1

(12) United States Patent
Matson

(10) Patent No.: US 6,190,140 B1
(45) Date of Patent: Feb. 20, 2001

(54) BELT-DRIVEN FAN WITH TENSION PRESERVING WINGED MOTOR MOUNTING

(75) Inventor: Carl G. Matson, Little Rock, AR (US)

(73) Assignee: Triangle Engineering of Arkansas, Inc., Jacksonville, AR (US)

( * ) Notice: Under 35 U.S.C. 154(b), the term of this patent shall be extended for 0 days.

(21) Appl. No.: 09/406,713

(22) Filed: Sep. 28, 1999

Related U.S. Application Data

(63) Continuation-in-part of application No. 09/040,865, filed on Mar. 18, 1998.

(51) Int. Cl.[7] ..... F04B 17/00; F04B 35/00

(52) U.S. Cl. ..... 417/362

(58) Field of Search ..... 415/210.1; 417/313, 417/362, 360, 16, 212, 319, 423.15; 180/68.1; 165/122; 416/246

(56) References Cited

U.S. PATENT DOCUMENTS

| | | | | |
|---|---|---|---|---|
| 3,112,852 | | 12/1963 | Norden et al. | 225/104 |
| 3,584,968 | * | 6/1971 | Keith | 415/210.1 |
| 3,726,611 | * | 4/1973 | Astrom | 417/362 |
| 3,943,728 | | 3/1976 | Maudlin | 62/507 |
| 4,092,088 | * | 5/1978 | Nemesi | 417/360 |
| 4,120,615 | | 10/1978 | Kemm et al. | 417/360 |
| 4,200,257 | | 4/1980 | Litch, III | 248/604 |
| 4,242,055 | * | 12/1980 | Felter | 417/362 |
| 4,341,506 | * | 7/1982 | Klein | 417/362 |
| 4,352,635 | * | 10/1982 | Saunders | 417/16 |
| 4,373,696 | | 2/1983 | Dochterman | 248/604 |
| 4,445,583 | * | 5/1984 | Mazur | 180/68.1 |
| 4,482,124 | | 11/1984 | Dochterman | 248/604 |
| 4,510,851 | | 4/1985 | Sarnosky et al. | 98/42.08 |
| 4,594,940 | | 6/1986 | Wolbrink et al. | 98/42.1 |
| 4,607,714 | * | 8/1986 | Uttenthaler | 180/68.1 |
| 4,655,693 | * | 4/1987 | Grime | 417/212 |
| 4,813,120 | | 3/1989 | Fournier | 29/426.6 |
| 5,014,409 | | 5/1991 | Hippach | 29/267 |
| 5,022,828 | * | 6/1991 | Myers | 417/362 |
| 5,079,791 | | 1/1992 | Grech | 7/169 |
| 5,186,605 | | 2/1993 | Tracy | 415/119 |

(List continued on next page.)

FOREIGN PATENT DOCUMENTS

| | | |
|---|---|---|
| 579687 | 6/1933 | (DE) . |
| 575561 | 2/1946 | (GB) . |

*Primary Examiner*—Teresa Walberg
*Assistant Examiner*—Leonid Fastovsky
(74) *Attorney, Agent, or Firm*—Stephen D. Carver

(57) ABSTRACT

High volume, belt-driven ventilation fans in which the bladed propeller assembly and the drive motor are operationally mounted upon a unitary structure. In one form of the invention a box-fan comprises a generally cubicle, or parallelepiped housing. In an alternative barrel fan the tubular housing is cylindrical. Both fans comprise a pair of rigid, vertically upright, parallel rails within their interior. A rigid, X-profiled mounting unit is fastened between the rails to mount both the propeller and the motor. The unitary mount comprises a rigid, central mandrel that coaxially receives the propeller assembly axle. Pairs of diverging arms extending away from each side of the mandrel are fastened to the rails within the fan interior. One of the arms pivotally supports a deflectable wing upon which the motor is mounted. The propeller assembly comprises a pulley-driven blade centered within the housing and an axle captivated within the mandrel. The motor drives a pulley mechanically coupled to the fan pulley with a V-belt. The axis of the wing's hinge, the axis of motor rotation, and the axis of rotation of the fan propeller are all parallel. A coiled spring biases the wing away from the mandrel, automatically tightening the belt as the motor borne by the wing is varied in position relative to the propeller axle in response to dynamic variables like start-up tension, load changes, aging, wear, and normal operational drive fluctuations. At all times proper drive belt tension is maintained.

19 Claims, 9 Drawing Sheets

U.S. PATENT DOCUMENTS

| | | | | |
|---|---|---|---|---|
| 5,269,662 | * | 12/1993 | Denton et al. | 417/319 |
| 5,348,447 | | 9/1994 | Redetzke | 416/247 |
| 5,368,453 | | 11/1994 | Peng | 417/423.5 |
| 5,378,119 | * | 1/1995 | Goertzen | 417/313 |
| 5,441,391 | * | 8/1995 | Frost et al. | 417/362 |
| 5,474,427 | | 12/1995 | Redetzke | 416/247 R |
| 5,480,282 | | 1/1996 | Matson | 415/125 |
| 5,738,167 | * | 4/1998 | Asbjornson et al. | 165/122 |
| 5,749,708 | | 5/1998 | Matson | 416/247 R |
| 5,951,257 | * | 9/1999 | Matson | 416/246 |
| 6,074,182 | * | 6/2000 | Matson | 417/423.15 |

* cited by examiner

BELT-DRIVEN FAN WITH TENSION PRESERVING WINGED MOTOR MOUNTING

CROSS REFERENCE TO RELATED APPLICATION

This application is a Continuation-in-part of Ser. No. 09/040,865, filed Mar. 18, 1998, entitled "Direct Drive Fan with X-shaped Motor Mounting," assigned to Examiner Henry C. Yuen in Group Art Unit 3747.

BACKGROUND OF THE INVENTION

I. Field of the Invention

This invention relates generally to high capacity, industrial and agricultural ventilation fans. More particularly, my invention relates to an improved, motor-mounting system for belt-driven fans that continuously maintains and regulates belt tension.

II. Description of the Prior Art

High volume fans provide ventilation and cooling for many agricultural facilities, especially in the poultry and dairy industries. Such fans are designed to properly control the direction, velocity, and volume of air being moved. I have previously proposed a fan adept at controlling air over long ranges. One of my previous fan inventions, issued as U.S. Pat. No. 5,480,282, on Jan. 2, 1996, and its teachings are hereby incorporated by reference. It was classified in U.S. Class 415, subclass 125. As can be seen from that patent and the prior art therein, the known prior art comprises many different types and designs of fans adapted to satisfy various criteria.

High volume ventilation fans include a rigid housing that protectively encloses the fan blade and motor. Protective guards shroud the housing. So-called "box fans" have a tubular housing that is "square," i.e., in the general form of a cube or parallelepiped. A tubular, cylindrical housing, in the form of a cylinder, is used by so-called "barrel fans," Depending upon the design and configuration, a number of different accessory items such as screen guards, shutters, electrical controls, discharge cones, and venturis may be deployed. Typical high capacity fans may be mounted on the ground, or secured in an elevated position upon an adequate support. The two principal fan-drive designs employed with modern high capacity fans are direct drive and belt-drive systems. Both arrangements have advantages and disadvantages.

Such fans are often deployed in rugged, industrial environments, where they may be used for long hours without periodic maintenance. As dust and dirt accumulate, vibrations develop, causing various parts to loosen. Obviously moving parts such as motors, belts, and rotors will wear with time. Periodic maintenance, while desirable, will be lacking in many industrial or agricultural applications. When maintenance is performed, the servicing technician faces a number of problems. The design features and differences between various fans used in a given application make it difficult to inventory proper parts, tools, and service diagrams. The servicing technician must possess knowledge of several different types and designs of fans. Another problem involves the protective safety guards installed on most fans. These must be removed to expose the fan's innards for service. Over time, the guards can vibrate loose, and in response to vibration and rough handling, they may become deformed and difficult to remove or adjust.

In general, the more a fan is used, the "looser" the guard and fan housing becomes. Often the housing is warped or damaged over time, and as a result, the guards simply do not "fit" as tightly as they did when the fan was newer.

Typically belt-driven ventilation fans have drive assemblies that are mounted on spaced-apart bearing/shaft assemblies. A drive motor is typically mounted such that its axis of rotation is parallel to and spaced apart from the fan shaft. The motor and fan shafts are connected by a suitable "V" belt entrained over pulleys that establish an adequate gear drive ratio. Many structural variations for mounting the fan, the motor, and the linkage components have been proposed. A major problem with belt-driven fans is the lack of a simple belt tensioning method.

As high capacity ventilation fans age, accumulating wear on the belts, motors and associated pulleys can loosen critical parts. When belt wear becomes appreciable, belt tension varies unpredictably, degrading performance. To maintain peak operating efficiency, belts in common designs must be inspected, and the apparatus must be adjusted relatively frequently. Unfortunately, this type of routine maintenance requires considerable time and effort. Tension adjustments to belt-driven fans generally require the removal of at least one guard. Consequently, structure that maintains belt integrity and reduces service requirements is desirable. A reliable system for automatically maintaining belt tension in a belt-driven fan would increase reliability, and optimize efficiency.

SUMMARY OF THE INVENTION

My new motor mounting system for belt-driven fans provides a system that inherently maintains proper belt tension. Fan longevity and reliability are increased, while service requirements are reduced. The disclosed mounting concept minimizes problems associated with mounting orientation and friction, and combines fan and motor mounting into a simple structure with a reduced number of parts. During operation the torsional reaction of the motor produces a tendency to increase the belt tension under heavy load conditions, like that encountered during starting. The pulling side of the belt is near the pivot of the motor mount, so the resultant torque stresses the motor toward the pulling side. As a result, slipping, is eliminated.

The preferred fan comprises a rigid, outer housing of a predetermined shape. The invention may be incorporated in "box fans" having a cubicle shape like a parallelepiped, or it can be employed with "barrel fans" having round or cylindrical housings. In either case at least pair of rigid, spaced-apart rails extend through the enclosure, preferably vertically. The rails also serve as a wire duct for the switch cord and the power cord, resulting in a smooth, aesthetically pleasing appearance. The "C-shaped" cross section of the preferred rails reduces turbulence as air rushes through the fan housing.

A single-piece, mounting unit with a generally "X-shaped" cross section is suspended between the frame rails and supports both the motor and the propeller assembly. The unit's arms, which form an "X-shaped" profile, enable the mounting unit to be rigidly secured between and to the rails. The arms diverge outwardly away from a rigid, tubular mandrel at the center of the mounting unit. The mandrel coaxially receives and rotatably mounts the fan axle. Thus the fan is centered for rotation coaxially with the mounting unit mandrel, between the rails.

Importantly, the motor is secured upon a deflectable wing that is pivoted with a rigid hinge to the body of the mounting unit. This mounting automatically compensates for dimensional changes and stresses. The hinge axis is parallel with the axis of rotation of the fan (i.e., the mandrel) and the motor. The motor and fan are mechanically coupled with a conventional V-belt entrained between suitable pulleys. A coiled, heavy-duty spring normally biases the wing to tension the belt. Since the wing hinge pivot axis is parallel to the axis of rotation of the fan and the drive motor, the motor drive pulley will remain coplanar with the fan pulley notwithstanding wing deflections.

In effect the wing is activated by the heavy-duty spring that yieldably biases it outwardly from the mount, with a force much greater than the weight of the motor and the unitary mounting assembly. Variations in motor position are rendered possible by the hinged wing, which will deflect as torque increases. In this manner, suitable belt tension is maintained and regulated.

The fan may be mounted vertically or horizontally over the motor, or upon either side. In other words, the motor may be oriented above or below the fan. Since both the fan and the motor are mounted within the fan by a single part, complexity is reduced while reliability is enhanced. In operation, no adjustment is required after assembly for the life of the fan. The unitary mounting system increases fan life and reliability significantly over more-complex, prior art, fixed-mounted fans. Preferably, there is in fact no adjustment—except when originally installing the "V" belt. The only specification is the center distance between the pulleys. The simplicity of the design eliminates damage from poor maintenance and the otherwise frequent need to drive belt inspect and/or adjust drive belt tension.

The manufacturing procedure is also simplified by having only a singular-mounting component to install. The instant mounting arrangement combines the fan and the motor on a unitary device that is easily fitted between upright rails within the cabinet. Installation requires only four bolts, reducing the parts required and critical assembly line time. Even though my new mounting unit is small and compact, the new design results in a much more rigid, and smoother running fan. Mounting requirements are relaxed, and a more flexible design that fits any size or shape of fan housing results.

This improved fan overcomes several perceived problems with known prior art belt-driven fans. One advantage is that belt size is no longer critical. In other words, one size of drive belt may be used for several different sizes and types of fans. Further, pulleys having differing diameters can be installed with ease. Consequently, fan servicing and component replacement are simplified. The serviceman's inventory of replacement parts is likely to include differently sized replacement parts like pulleys and belts that will fit fans of this design properly. Component alignment is enhanced as well, as both the fan and the motor are secured upon a common structure.

Thus, a primary object of my invention is to provide a belt-driven fan characterized by low maintenance requirements and enhanced reliability.

Another object is to provide a belt driven fan with a motor mounting system characterized by simplicity and a reduced number of parts.

Another fundamental object is to provide an improved motor and fan mounting system for a belt-driven ventilation fan.

Another very important object is to provide an improved motor and fan mounting system for a belt-driven ventilation fan that makes it easier to maintain correct dynamic alignment of rotating parts.

A related object is to provide a simplified structural unit that mounts both the propeller assembly and the drive motor.

Another object is to provide a motor mounting system of the character described that enables the motor and propeller assembly to be mounted in alternative orientations.

A related object is to provide a motor mounting system of the character described that enables the motor to be mounted on opposite sides of the fan. It is a feature of the invention that the rails may be mounted horizontally, and if so, the motor may be mounted on either side of the fan along the frame rails.

Yet another object of this invention is to produce an improved belt-driven fan that has reduced service requirements.

Another general object is to provide a belt-driven fan that will accept drive-belts having different lengths.

A still further object is to provide a fan that is readily capable of use either inside or outdoors.

A related object of the invention is to provide a fan that automatically and properly tensions its drive belt.

Another important object of the present invention is to produce a belt-driven fan of the character described that maintains optimum belt tension.

A related object is to provide a belt-tensioning device that works automatically.

A related object is to provide a belt-driven fan that reduces noise and vibration.

A related object of the present invention is to provide a fan of the character described that enables pulleys with varying diameters to be installed quickly on the assembly line.

These and other objects and advantages of the invention, along with features of novelty appurtenant thereto, will appear and become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE DRAWINGS

Figure 1:
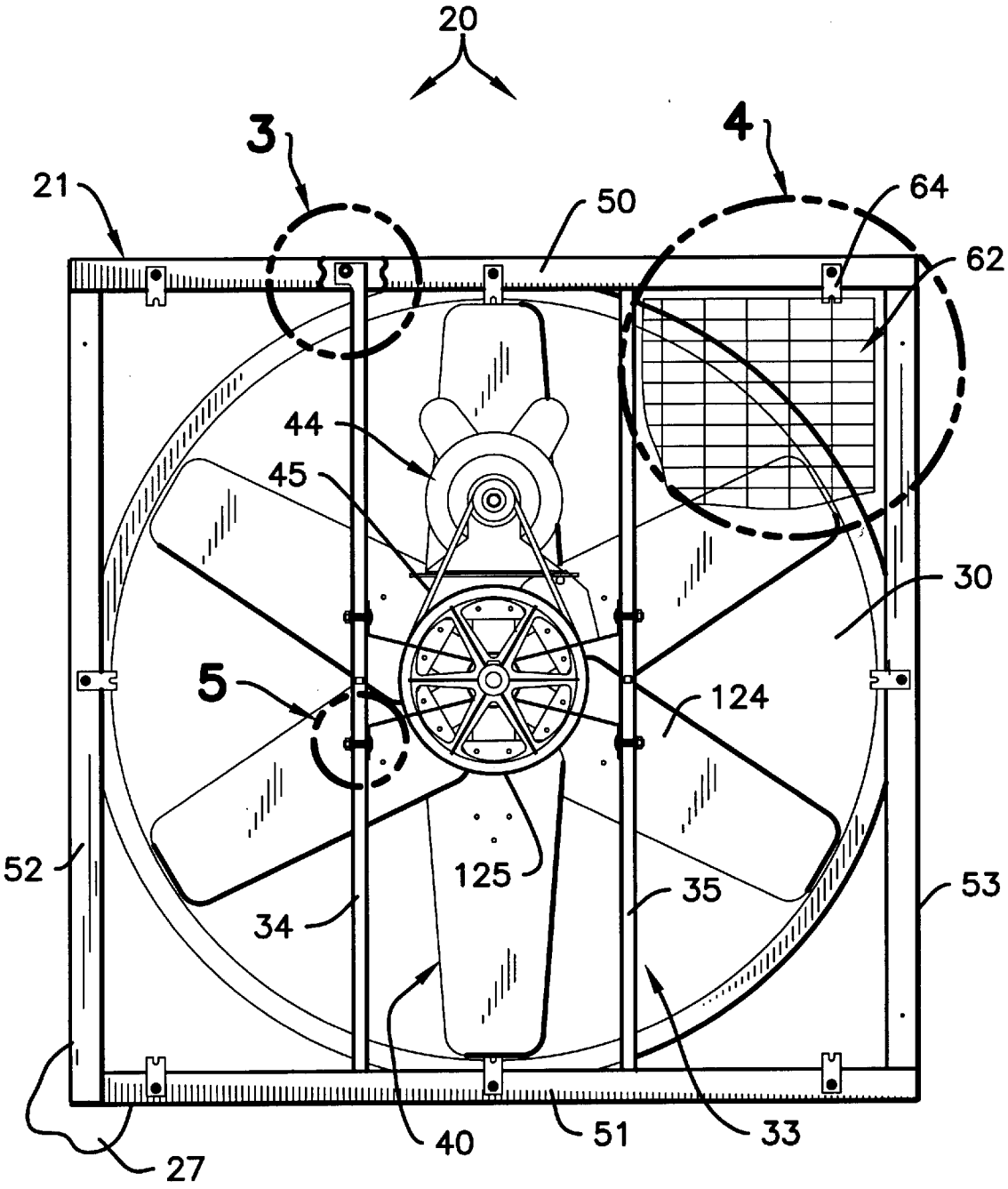
FIG. 1 is a fragmentary, front elevational view of an improved belt-driven "box fan" constructed in accordance with the best mode of the invention.

With initial reference directed to FIGS. 1 and 6–11 of the appended drawings, a belt-driven, box fan is generally designated by the reference numeral 20. Fan 20 comprises a generally tubular, box-like housing 21 in the shape of a parallelepiped or cube. Box housing 21 has a square or rectangular cross section. An alternative barrel fan 23 (FIG. 2) comprises a generally tubular, "round" housing 24, generally in the form of a cylinder. Housing 24 has a circular cross section. Preferably both fans 20 and/or 23 are mounted from an elevated support. However, they may be disposed upon a horizontal, supporting surface 27. The barrel fan 23 preferably comprises conventional legs 28 secured to the periphery of cylindrical housing 24 for stability when placed on the ground. Alternatively, fans 20 and/or 23 may be mounted upon pedestals, or suspended from other suitable mechanical supports by conventional brackets or braces (not shown) that are well known to those skilled in the art. In use the fans are appropriately aimed at a desired target area.

Fan 20 (FIG. 1) has an internal volume 30 confined by box housing 21 that contains the mounting system 33. A similar mounting system 33A is employed by the barrel fan 23 (FIG. 2) in its interior 31. Mounting systems 33 (FIG. 9) and 33A are very similar. Each fan internally comprises a pair of spaced apart rails 34, 35 or 34A, 35A respectively made of channel steel, that secure a unitary mount 38 best seen in FIGS. 9–11. The X-shaped mount 38 secures the propeller assembly 40 and conventional, electric drive motor 44 in spaced-apart, aligned relation within the housing interiors between the rails 34, 35 or 34A, 35A. By the term "unitary" it is meant that the generally X-shaped mount 38 mechanically secures both the propeller assembly and the drive motor.

A conventional V-belt 45 mechanically couples the motor 44 to the propeller assembly 40. As will be recognized by those skilled in the art, the fan blade is preferably coaxially centered within a venturi 47 (FIG. 6) or 47A (FIG. 2) that enhances fan efficiency. Rails 34, 35 are adapted to be fitted within the box-like enclosure of fan 20, and each has a generally C-shaped cross section to minimize turbulence. Each rail also has a plurality of spaced apart, elliptical orifices 36 (FIGS. 8, 9) defined along its length.

The only difference in the mounting systems 33, 33A, is the size and shape of the rails. Rails 34A, 35A (FIG. 2) are formed to fit within the "round" or cylindrical housing 24 of fan 23. Both fans 20, 23 use the X-shaped mount 38, the same motor 44, and the same propeller assembly 40. With this in mind, only fan 20 will be discussed in detail hereinafter.

Figure 2:
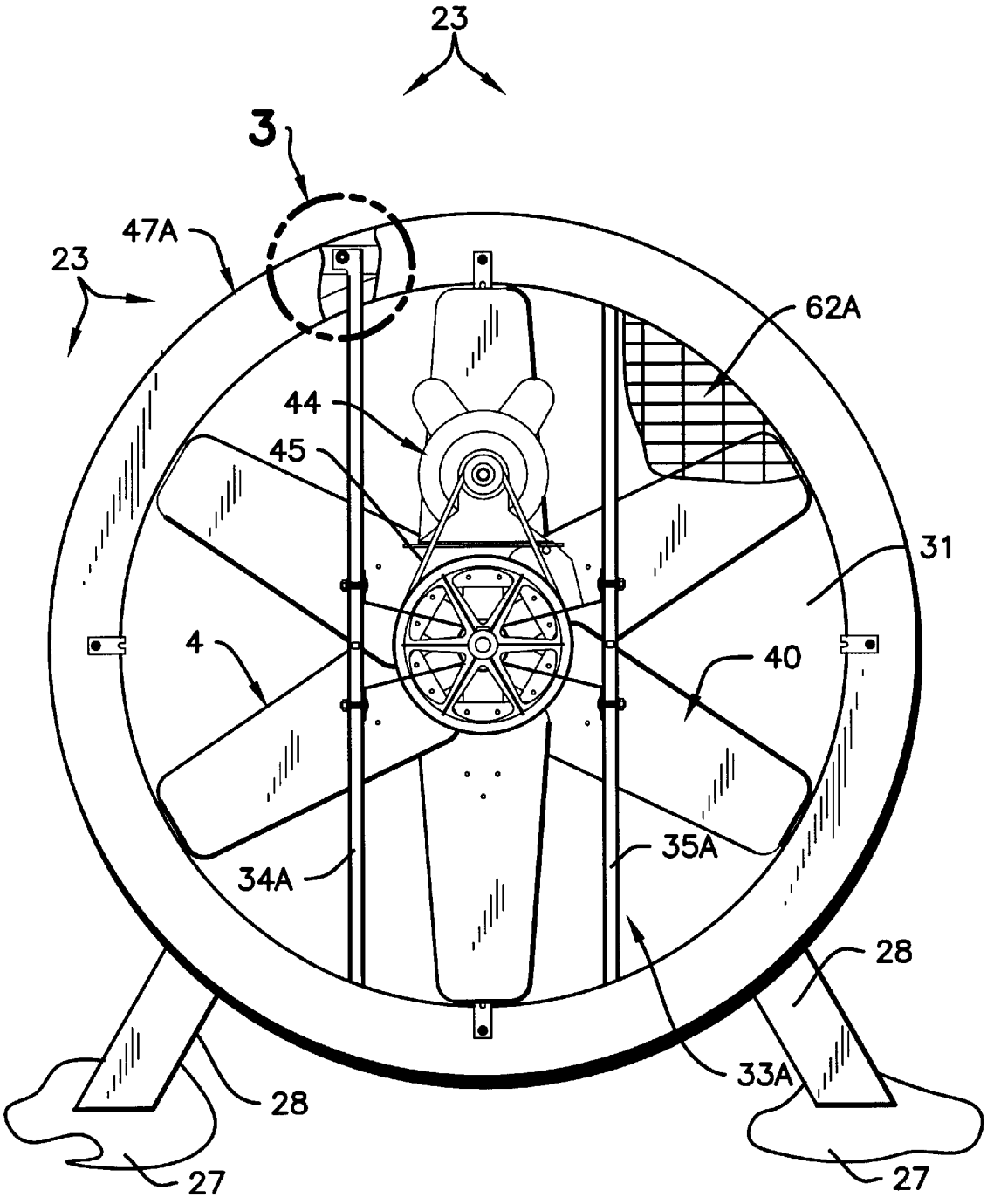
FIG. 2 is a fragmentary, front elevational view of an improved belt-driven "barrel fan" constructed in accordance with the best mode of the invention.
Figure 3:
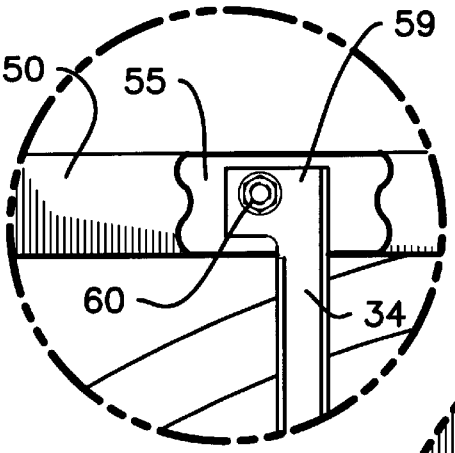
FIG. 3 is an enlarged, partially fragmentary plan view of circled region "3" in FIG. 1.

The front of fan 20 is seen in FIG. 1. The housing 21 comprises a top 50, a bottom 51, and a pair of sides 52 and 53. An elongated, rigid internal strut 55 (FIGS. 3, 6) extends horizontally across the top within the fan housing. A similar strut 56 (FIG. 6) is secured to the fan bottom 51 in parallel, co-planar relation. The mounting system 33 is secured between struts 55, 56. Rails 34 and 35 extend in parallel, spaced relation between struts 55, 56 inside the housing. Each rail has a flange portion 59 (FIG. 3) defined at both ends for connection to the struts 55 and 56 as in FIG. 3. While one pair of struts are illustrated, it is within the purview of my invention to employ an additional pair for reinforcement purposes, and, as seen in FIG. 9, X-shaped mount 38 has holes in its rear for this eventuality.

Figure 4:
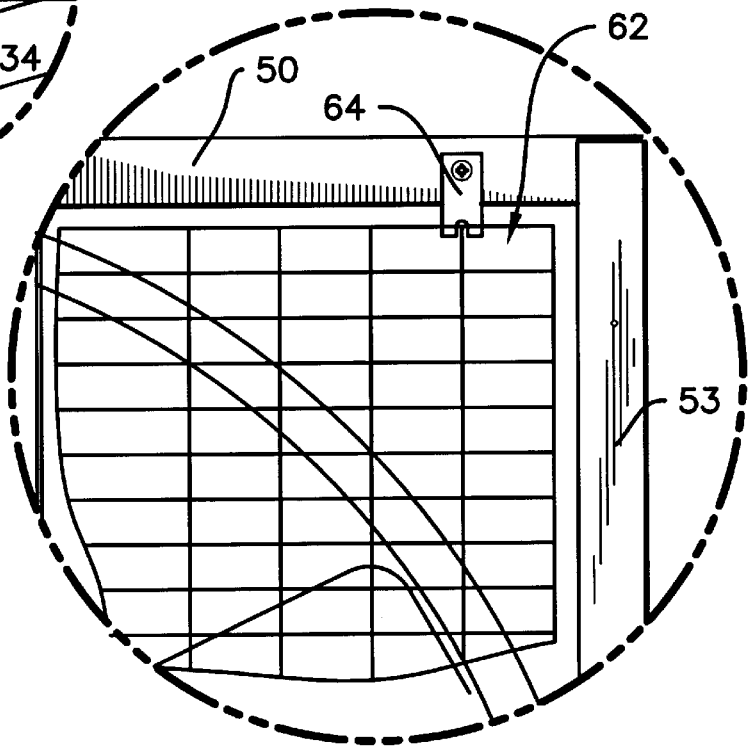
FIG. 4 is an enlarged, partially fragmentary plan view of circled region "4" in FIG. 1.

For safety purposes, both fans 20 and 23 are equipped with screen-like guards to enclose the interior. Fan 20 preferably comprises a flat, square, screen guard 62 of conventional construction. As best seen in FIG. 4, guard 62 can be secured to the fan housing with conventional brackets 64. The removable circular screen-like guard 62A on fan 23 (FIG. 2) is similarly secured. A variety of different guards, including proprietary Triangle Engineering snap-in guards, may alternatively be employed.

Figure 5:
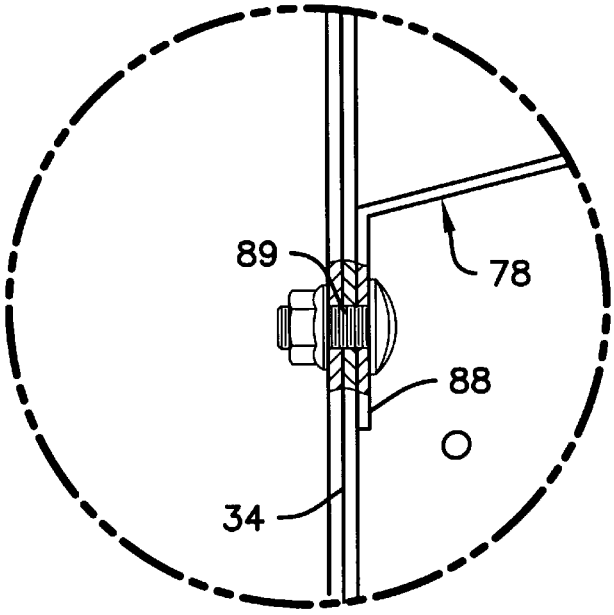
FIG. 5 is an enlarged, partially fragmentary plan view of circled region "5" in FIG. 1.
Figures 9, 12:
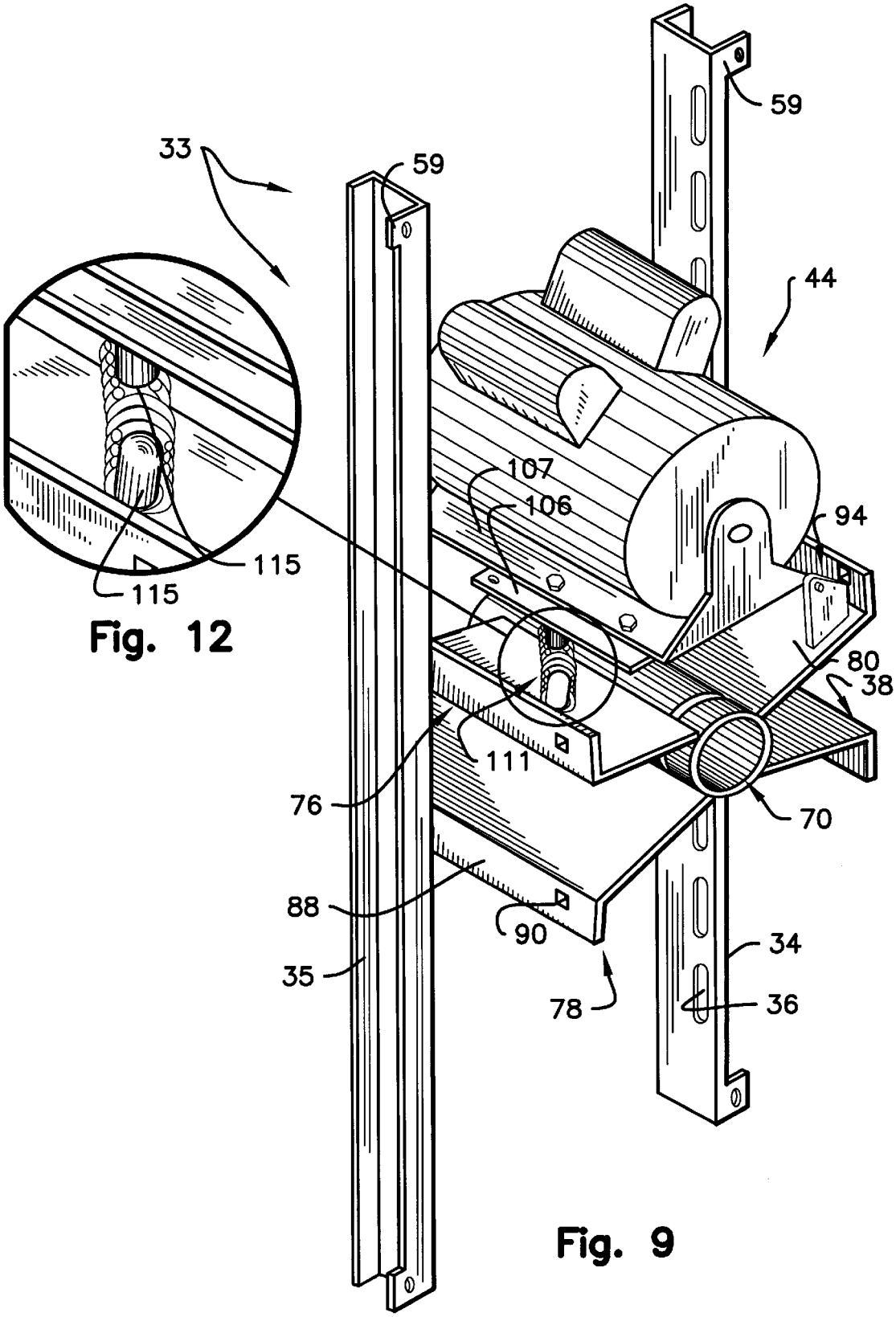
FIG. 9 is an enlarged, isometric assembly view of the preferred motor, the supporting winged mounting unit, and the frame rails.
Figure 10:
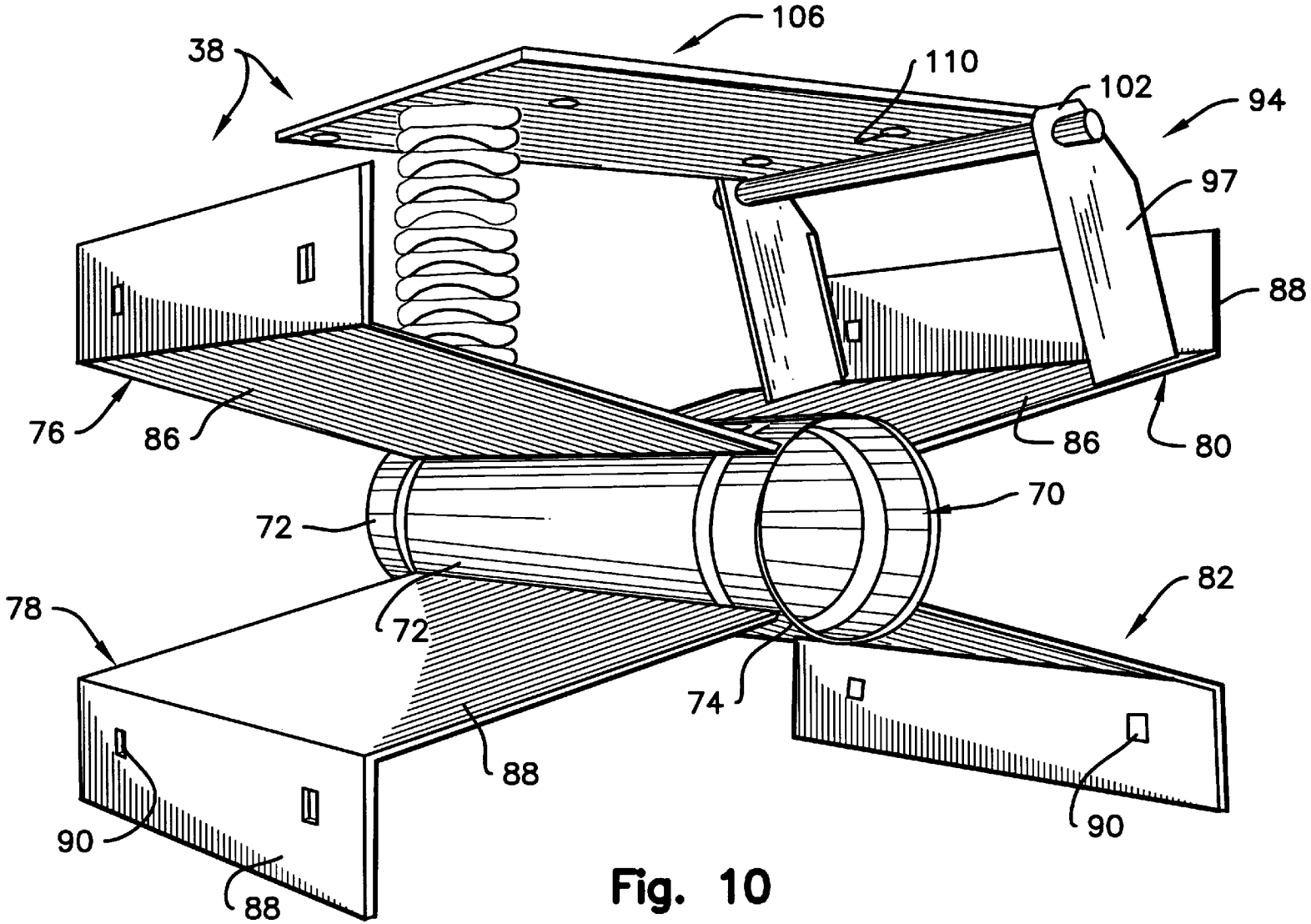
FIG. 10 is an enlarged, frontal isometric view of the preferred motor and fan mounting unit.
Figure 11:
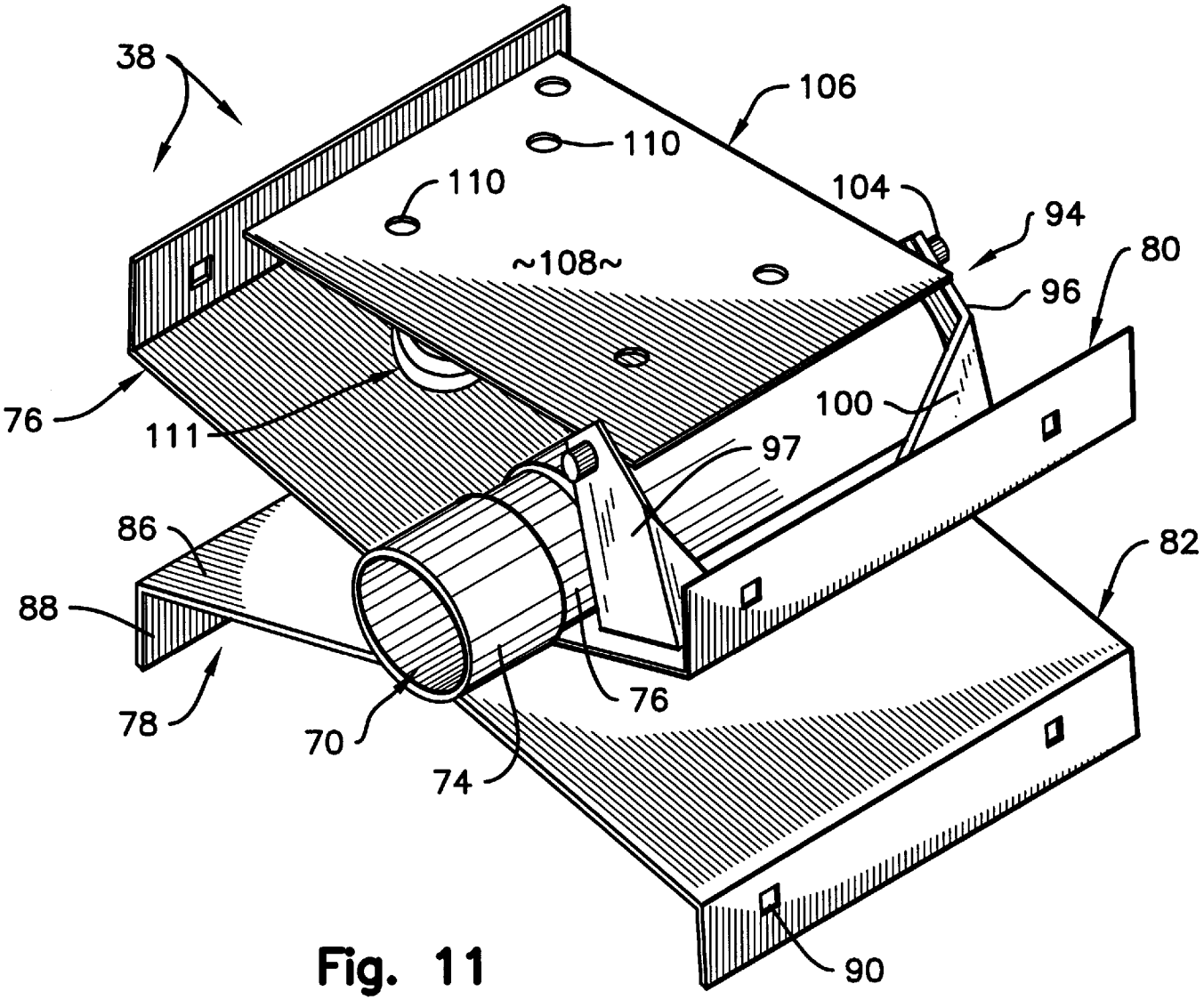
FIG. 11 is an enlarged, frontal isometric view similar to FIG. 9, but taken from a position generally to the right of FIG. 9; and, FIG. 12 is an enlarged, fragmentary isometric view of circledregion 12 in FIG. 9.

With primary reference now directed to FIGS. 9–11, the X-shaped mount 38 comprises a rigid, tubular mandrel 70 at its center. Mandrel 70 comprises a central, tubular body portion 72 terminating at both ends in rigid sleeve ends 74. A pair of generally planar arms extend away from each side of the mandrel 70, forming an "X-shaped" profile. A first pair, comprising diverging arms 76 and 78 (FIGS. 10, 11), projects towards the left (i.e., as viewed in FIG. 10). A companion pair comprising diverging arms 80, 82 projects away from the right side of mandrel 70. Each arm is similar. For example, arm 78 comprises a rigid, flat, rectangular body 86 having an inner edge welded to mandrel 70 and an outer edge terminating in an integral, angled flange 88 (FIG. 5). A pair of mounting holes 90 in each arm's flange 88 are aligned in assembly with suitable orifices 36 (FIG. 9) defined in the rails 34, 35. With the mounting holes registered, suitable fasteners 89 (FIGS. 5, 8) permanently mount the X-unit between the rails.

Arm 80 supports the motor mounting wing assembly 94 (FIGS. 9–11). A pair of parallel and spaced apart tabs 96, 97 project upwardly from upper arm 80. These tabs are welded to the main arm body 86 adjacent the outer flange 88. Each tab comprises a triangulated web 100 (FIG. 11) at its base for reinforcement. The tops 102 of each tab are apertured to rotatably mount an elongated hinge pin 104 that extends between tabs 96 and 97. A rigid wing 106 of generally rectangular dimensions is welded to hinge pin 104 for pivotal displacement towards and away from away mandrel 70. Wing 106 comprises a rigid, flat plate that supports the drive motor. As detailed hereinafter, mandrel 70 establishes the axis of rotation of the propeller assembly that is parallel with the pivot axis established by pin 104.

Wing 106 dynamically supports drive motor 44, enabling it to automatically deflect towards or away from the mandrel 70 during operation. This self-compensating action maintains proper belt tension. As best seen in FIG. 9, motor 44 is secured by support 107 that is attached atop upper, outer wing surface 108 (FIGS. 9, 11) with suitable fasteners 113 (FIG. 9) penetrating plate orifices 110 (FIGS. 10, 11). The motor supporting wing 106 is yieldably biased away from mandrel 70 by a heavy duty, coiled spring 111 (FIGS. 10, 12). The wing underside 112 is contacted by the upper end of the spring 111, and the lower end of the spring is seated upon arm 76 of mount 38. As best seen in FIG. 12, each end of the spring 111 coaxially surmounts a rigid, generally cylindrical spring guide 115.

Figure 6:
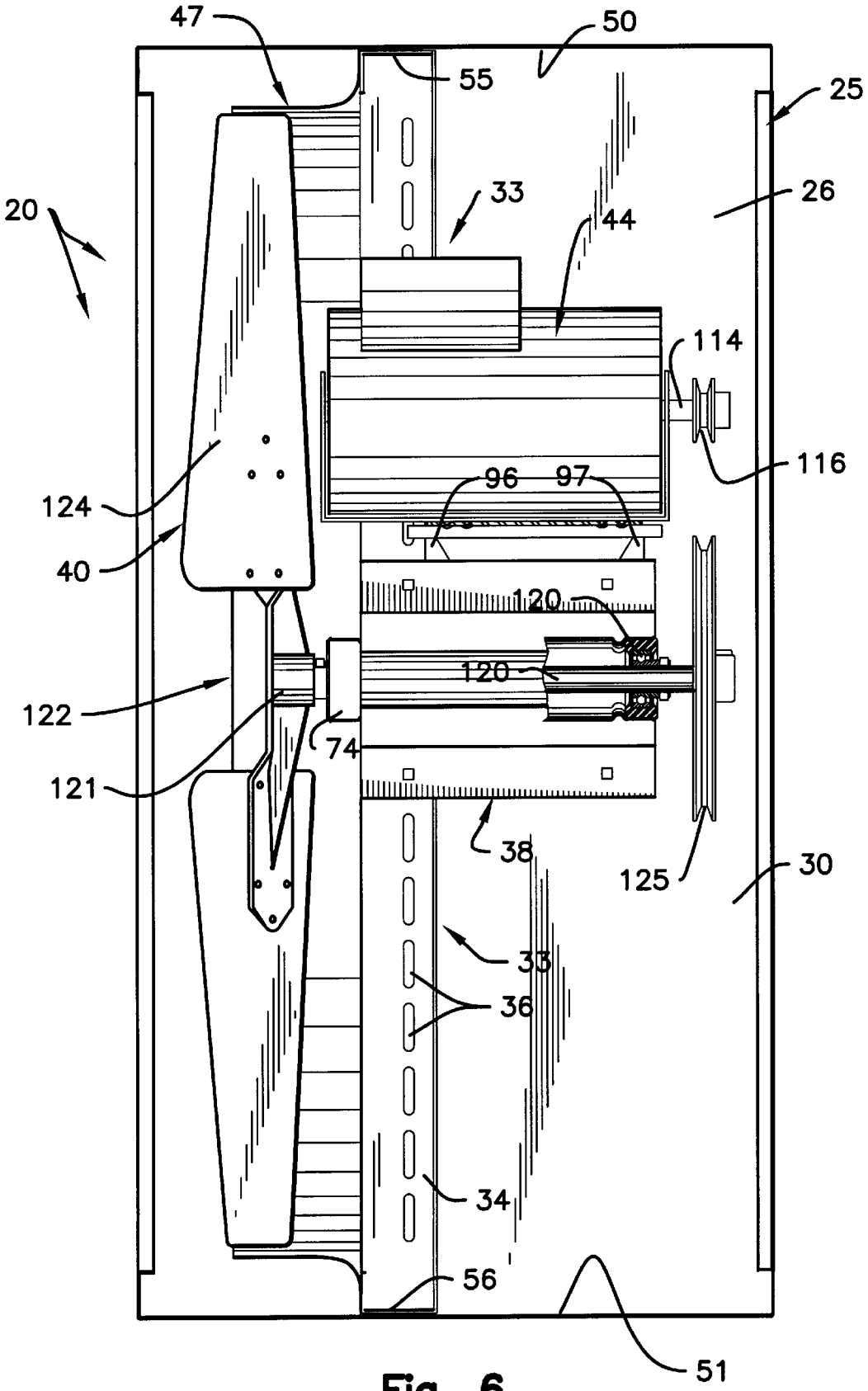
FIG. 6 is an enlarged, partially fragmentary, longitudinal sectional view of the fan of FIG. 1, with portions thereof omitted for clarity.
Figure 7:
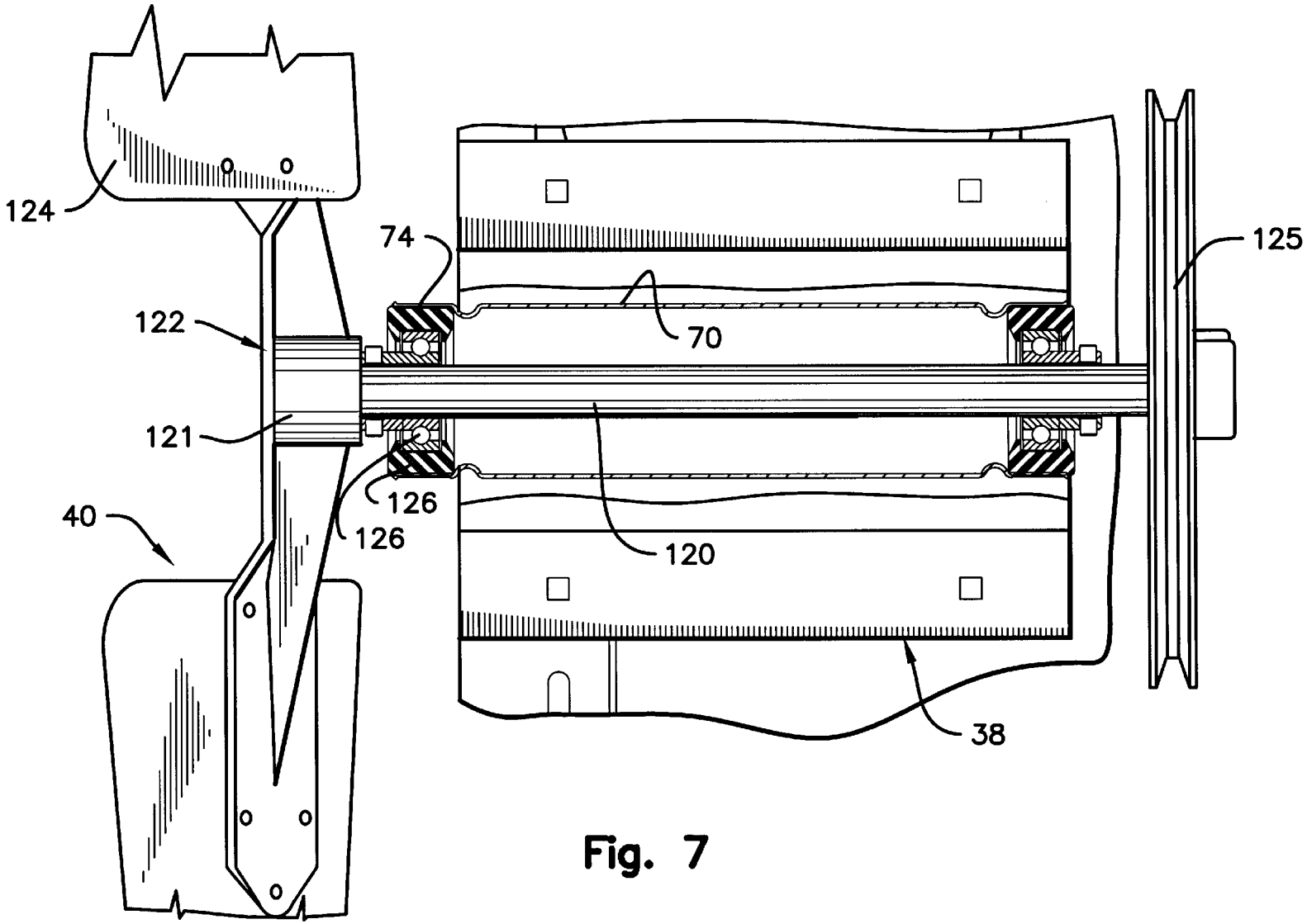
FIG. 7 is a greatly enlarged, partially fragmentary view of the fan mounting section, with portions thereof broken away, shown in section, or omitted for clarity.
Figure 8:
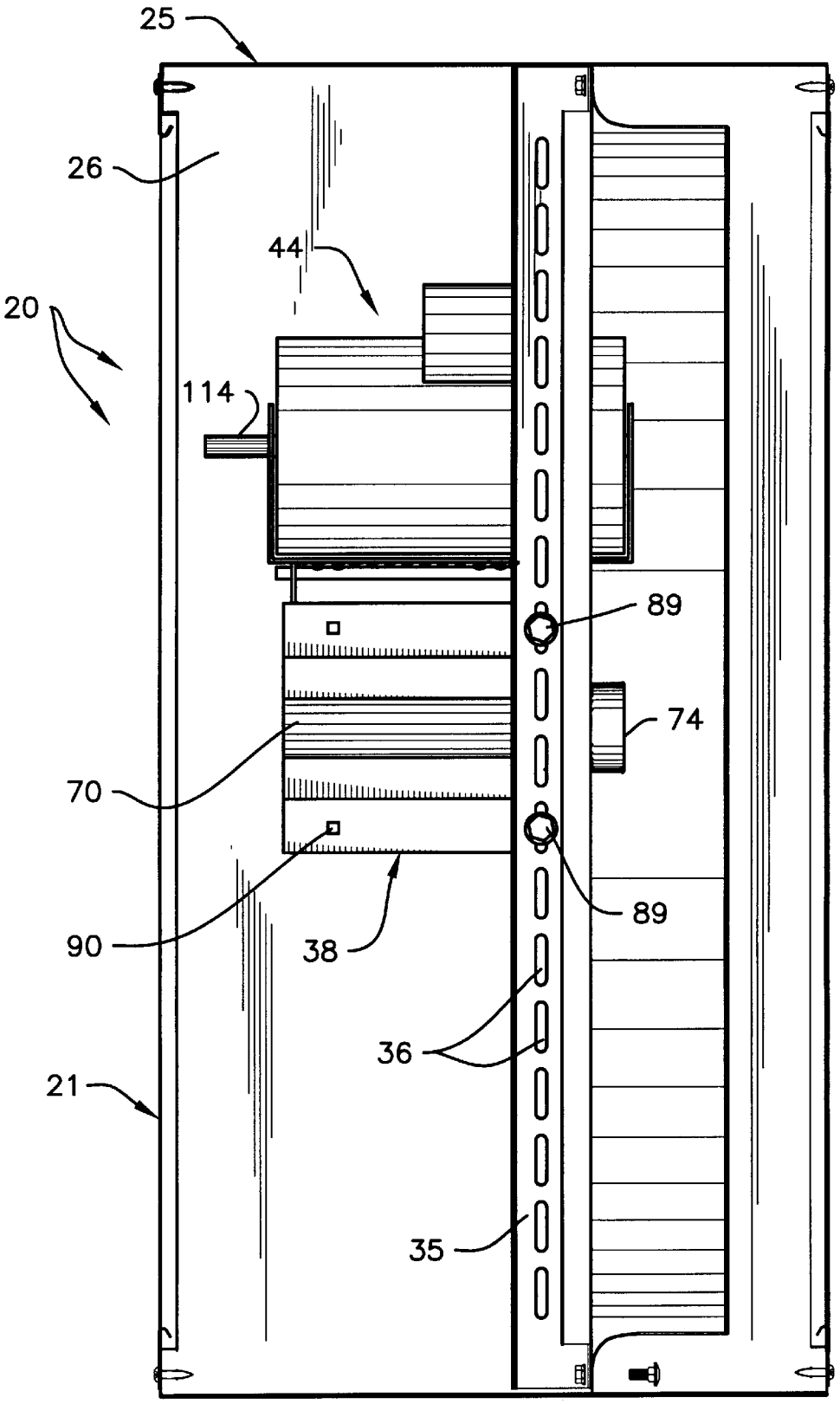
FIG. 8 is an enlarged, partially fragmentary, longitudinal sectional view of the fan similar to FIG. 6, but taken from the opposite side, and with portions thereof omitted for clarity.

The conventional, electric, capacitor start motor 44 sits atop the X-shaped mount 38 on wing 106, with its output shaft 114 (FIGS. 6, 8) terminating in a drive pulley 116 (FIG. 6). The axis of rotation of the motor is established by, and coincident with shaft 114. Preferably the motor axis of rotation, and shaft 114, are parallel with the axis of rotation of the propeller assembly, the longitudinal axis of mandrel 70, and hinge pin 104. The motor output speed is approximately 1750 RPM, requiring pulley 116 and the fan pulley to divide the fan speed range down to approximately 500–800 RPM.

The propeller assembly 40 (FIGS. 6, 7) comprises an axle 120 that is coaxially disposed within mandrel 70. The axis of rotation of the propeller assembly 40 is established by, and coincident with axle 120, which terminates at its output end in a rigid collar 121 that locks it to hub 122. A plurality of conventional, radially spaced-apart blades 124 are supported by hub 122 for rotation. Axle 120 is rotatably captivated within mandrel sleeve ends 74, being supported by bearings 126 (FIG. 7) that are coaxially press-fitted into resilient bushings 128. Axle 120 is driven by pulley 125 that is coupled to motor 44 by the V-belt 45.

During operation, the wing can be slightly deflected towards or away from the fan center. Thus fan belt tension is automatically regulated. As the belt wears, the spring 111 will deflect the wing 106 vertically to maintain constant drive pressure between pulleys 116 and 125. To compensate for torsionally induced shocks experienced during start-up, spring 111 temporarily compresses slightly. The design can be used with a variety of fans to promote long life and maintenance free operation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A ventilation fan comprising:

a rigid housing;

a pair of rigid, spaced-apart rails extending through said housing;

rotatable propeller means disposed within said housing for forcing air therethrough, said propeller means comprising an axle;

motor means for actuating said propeller means;

belt means for mechanically coupling said propeller means to said motor means; and, unitary mounting means for securing both said motor means and said propeller means within said housing, said unitary mounting means comprising a central mandrel coaxially receiving said axle and means supporting said motor means in spaced relation relative to said mandrel for automatically maintaining correct belt means tension.

2. The ventilation fan as defined in claim 1 wherein said means supporting said motor means for automatically maintaining correct belt means tension comprises a pivoted wing for supporting said motor means.

3. The ventilation fan as defined in claim 2 wherein said unitary mounting means for supporting said motor means comprises pairs of outwardly diverging arms adapted to be coupled to said rails.

4. The ventilation fan as defined in claim 3 wherein said pairs of arms form an X-shaped profile.

5. The ventilation fan as defined in claim 3 wherein said each of said arms comprises a rigid, flat, rectangular body having an inner edge welded to said mandrel and an outer flange adapted to be fastened to said rails.

6. The ventilation fan as defined in claim 5 wherein said pairs of arms form an X-shaped profile in conjunction with said mandrel.

7. The ventilation fan as defined in claim 5 wherein said wing is hinged to one of said arms.

8. The ventilation fan as defined in claim 7 further comprising spring means for biasing said wing away from said arm.

9. The ventilation fan as defined in claim 8 wherein:

said motor means comprises an axis of rotation;

said wing has a pivoting axis; and, said pivoting axis and said motor means axis of rotation are parallel with said propeller means axle.

10. A ventilation fan comprising:

a rigid housing;

a pair of rigid, spaced-apart rails extending through said housing;

rotatable propeller means disposed within said housing for forcing air therethrough, said propeller means comprising an axle;

motor means for actuating said propeller means;

belt means for mechanically coupling said propeller means to said motor means; and, unitary mounting means for securing both said motor means and said propeller means within said housing between said rails, said unitary mounting means comprising a central mandrel coaxially receiving said axle and wing means for automatically maintaining correct belt means tension, said wing means comprising:

a rigid wing pivoted to said unitary mounting for supporting said motor means; and, spring means for normally yieldably biasing said wing away from said mandrel.

11. The ventilation fan as defined in claim 10 wherein said unitary mounting means for supporting said motor means comprises two pairs of outwardly diverging arms adapted to be coupled to said rails.

12. The ventilation fan as defined in claim 11 wherein said pairs of arms form an X-shaped profile.

13. The ventilation fan as defined in claim 12 wherein said each of said arms comprises a rigid, flat, rectangular body having an inner edge welded to said mandrel and an outer flange adapted to be fastened to said rails.

14. The ventilation fan as defined in claim 12 wherein said wing is pivoted to one of said arms, and said spring means extends between said wing and a lower arm.

15. The ventilation fan as defined in claim 12 wherein:

said motor means comprises an axis of rotation;

said wing means has a pivoting axis; and, said pivoting axis and said motor means axis of rotation are parallel with said propeller means axle.

16. A ventilation fan comprising:

a rigid housing;

a pair of rigid, spaced-apart rails extending vertically upwardly through said housing;

rotatable propeller means disposed within said housing for forcing air therethrough, said propeller means comprising an axle;

motor means for actuating said propeller means;

belt means for mechanically coupling said propeller means to said motor means; and, unitary mounting means for securing both said motor means and said propeller means within said housing between said rails, said unitary mounting means comprising a central mandrel coaxially receiving said axle, a first pair of arms diverging from one side for connection with one of said rails, a second pair of arms diverging from an opposite side for connection with the other of said rails, and wing means for automatically maintaining correct belt means tension, said wing means comprising:

a rigid, generally planar wing pivoted to one of said arms; and, spring means for normally yieldably biasing said wing away from said mandrel to tension said belt.

17. The ventilation fan as defined in claim 16 wherein:

each of said arms comprises a flat, generally rectangular body having an inner edge welded to said mandrel and an outer flange adapted to be fastened to said rails; and, said pairs of arms form an X-shaped profile together with said mandrel.

18. The ventilation fan as defined in claim 17 wherein said wing is pivoted to one of said arms, and said spring means extends between said wing and an arm.

19. The ventilation fan as defined in claim 18 wherein:

said motor means comprises an axis of rotation;

said wing means has a pivoting axis; and, said pivoting axis and said motor means axis of rotation are parallel with said propeller means axle.

* * * * *